US012636692B2

(12) United States Patent
Galli et al.

(10) Patent No.: US 12,636,692 B2
(45) Date of Patent: May 26, 2026

(54) FRONT LOADING EXTRUSION PRESS FOR PRODUCING METAL EXTRUDATES BY EXTRUDING A BILLET

(71) Applicant: DANIELI & C. OFFICINE MECCANICHE S.P.A., Buttrio (IT)

(72) Inventors: Alessandro Mario Galli, Costa Masnaga (IT); Paolo Ballarini, Milan (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 421 days.

(21) Appl. No.: 18/255,565

(22) PCT Filed: Dec. 2, 2021

(86) PCT No.: PCT/IB2021/061216
§ 371 (c)(1),
(2) Date: Jun. 1, 2023

(87) PCT Pub. No.: WO2022/118229
PCT Pub. Date: Jun. 9, 2022

(65) Prior Publication Data

US 2024/0001421 A1 Jan. 4, 2024

(30) Foreign Application Priority Data

Dec. 4, 2020 (IT) ..... 102020000029909

(51) Int. Cl.
*B21C 23/04* (2006.01)
*B21C 23/21* (2006.01)

(52) U.S. Cl.
CPC ..... *B21C 23/04* (2013.01); *B21C 23/212* (2013.01)

(58) Field of Classification Search
CPC ..... B21C 23/04; B21C 23/21; B21C 23/211; B21C 23/212; B21C 23/20
See application file for complete search history.

(56) References Cited

FOREIGN PATENT DOCUMENTS

CN 108620444 A * 10/2018 ..... B21C 23/21
DE 3011134 A1 10/1981
(Continued)

OTHER PUBLICATIONS

Patent Cooperation Treaty, International Search Report and Written Opinion for International Application No. PCT/IB2021/061216, Mar. 14, 2022, 12 pages.

*Primary Examiner* — Debra M Sullivan
(74) *Attorney, Agent, or Firm* — Stetina Garred Brucker & Newboles

(57) ABSTRACT

An extrusion press for producing metal items by extruding a metal billet, said press comprising an extrusion die and a main cylinder including an extrusion punch adapted to be translated in two opposite directions, wherein the translation of said extrusion punch in a first extrusion direction results in a push against said billet and in the extrusion of said billet through said extrusion die, said press comprising a container and a movable punch holder crosspiece, both being translatable in two opposite directions parallel to the translation directions of said extrusion punch, wherein said container is adapted to be translated by means of at least a first dedicated cylinder including a first dedicated rod rigidly fastened to said container, and wherein said container is adapted to be moved close to said extrusion die by means of said dedicated first cylinder and rod so as to contain said billet.

16 Claims, 10 Drawing Sheets

(56) References Cited

FOREIGN PATENT DOCUMENTS

| | | | | |
|---|---|---|---|---|
| GB | 2005172 | A | 4/1979 | |
| JP | 2016163902 | A | 9/2016 | |
| WO | WO-2020023701 | A1 * | 1/2020 | ..... B21C 33/004 |

* cited by examiner

FRONT LOADING EXTRUSION PRESS FOR PRODUCING METAL EXTRUDATES BY EXTRUDING A BILLET

CROSS-REFERENCE TO RELATED APPLICATIONS

This application claims priority to PCT International Application No. PCT/IB2021/061216 filed on Dec. 2, 2021, which applications claims priority to Italian Patent Application No. 102020000029909 filed on Dec. 4, 2020, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention belongs to the technical field of iron and steel industry. In particular, the present invention belongs to the technical field of producing metal items by extruding a billet. In detail, the present invention relates to an extrusion press, in particular a front loading extrusion press. Even more in detail, the present invention relates to an extrusion press of the aforesaid type including an innovative solution for translating movable components.

Background Art

It is known to use front loading extrusion presses in the technology of producing metal items, in particular metal section bars, by extruding a billet.

A conventional front loading extrusion press of the known type is depicted in FIG. 1 and comprises a main cylinder 1, two side or return cylinders 2, two or more cylinders 3 for translating (in two opposite translation directions) a container 4, an extrusion crosspiece+extrusion die 5, and a movable crosspiece 6.

The main cylinder 1, usually of the hydraulic type, is the largest among those with which the press is equipped and ensures the greatest push force by means of the respective extrusion punch 8; the increased dimensions of the chamber of the main cylinder 1 make the extrusion punch 8 unsuitable for quick and/or fast movements. The main cylinder 1 conventionally is of the single-action type, wherein the chamber of cylinder 1 is placed in communication with a pre-filling valve 7 which in turn is in communication with a tank (not depicted) of a hydraulic fluid, conventionally hydraulic oil. Closing of valve 7 and the subsequent introduction of pressurized oil by means of high pressure pumps (not depicted) into the chamber of cylinder 1 results in generating the advancing translation of the extrusion punch 8 towards die 5. Contrarily, quick movements of the extrusion punch 8, both forwards towards the die 5 and backwards (in jargon, for the "return" of the extrusion punch 8), are obtained by means of the two side cylinders 2. In particular, prior to the actual extrusion step, the billet is blocked between the extrusion punch 8 and die 5 by means of the side cylinders 2, wherein contrarily, at the end of the actual extrusion step, the extrusion punch 8 is "returned" (moved away from die 5), again by means of the side cylinders 2. As for container 4, it is translated (according to the methods below) both towards die 5 and away from die 5 by means of the dedicated cylinders 3.

A standard extrusion cycle performed by means of a press according to the prior art of the type depicted in FIG. 1 may be summarized as follows.

During a first step, a billet is loaded between the front face of the extrusion punch 8 and die 5;

- during the next step, the extrusion punch 8 is advanced, by means of the side cylinders 2, towards die 5 in order to block the billet against the face of die 5 opposite to the extrusion punch 8;
- container 4 is then advanced, by means of the dedicated cylinders 3, up to abutting against die 5 (and therefore so that the billet is contained in container 4);
- during the next step, valve 7 is closed; and
- the billet is then upset to cause it to adhere to the walls of container (4) (by means of the push of the rods of the side cylinders 2 which move the extrusion punch 8);
- during the next step, container 4 is quickly opened and closed by means of the dedicated cylinders 3 (in order to allow the air possibly trapped in container 4 to escape);
- the next step is that of actual extrusion during which the extrusion punch 8 is pushed against the billet also with the aid of the side cylinders 2 (in this respect, it is worth considering that the rods of the side cylinders 2 are rigidly connected to the extrusion punch 8 by means of the movable punch holder crosspiece 6);
- during the next step, i.e., once the actual extrusion is complete, container 4 is opened (retracted) by means of the dedicated cylinders 3;
- the extrusion punch 8 is then retracted by means of the side cylinders 2;
- finally, any remains of the billet adhering to die 5 are removed.

The subsequent extrusion cycle thus starts with loading a new billet between the extrusion punch 8 and die 5 and continues according to the steps summarized above.

Extrusion presses according to the prior art of the type depicted in FIG. 1 have various disadvantages and/or drawbacks which the Applicant wanted to overcome or at least minimize by the present invention.

Firstly, it is worth considering that the presence of the side cylinders makes the press decidedly cumbersome, wherein the dimensions of the press and the need to provide adequate maneuvering spaces for the side cylinders make it difficult, if not impossible, to place the press in work environments with small dimensions.

Moreover, the side cylinders increase the need for maintenance and/or repair interventions on the press, given that they are subject to breakdowns and/or malfunctions.

And again, as anticipated, the use of the side cylinders during the actual extrusion step as support to the action of the main cylinder may give rise to undesired bending and/or distortions, for example in the event the force generated by one of the two cylinders does not exactly correspond to that generated by the second cylinder, or in the event of slender rods subject to buckling.

Finally, the presence of the side cylinders results in an oversizing of at least some of the components of the press to be necessary, for example of the movable punch holder crosspiece and the main cylinder crosspiece, also in this case with negative repercussions in terms of excessive dimensions and overall cost of the press.

Examples of extrusion presses according to the prior art are known from each of the documents JP 2016163902, GB 2005172 and DE 3011134.

Objects of the Present Invention

Therefore, it is a primary object of the present invention to provide an extrusion press, in particular a front loading extrusion press, which allows overcoming or at least reducing the disadvantages and/or drawbacks encountered in the extrusion presses according to the prior art.

In particular, it is the object of the present invention to provide an extrusion press which does not provide the use of the side cylinders commonly used for quickly moving the rod of the main cylinder.

Moreover, among the objects of the present invention there is the reduction of the hydraulic complexity of the machine (eliminating hydraulic blocks and pipes).

It is a further object of the present invention to provide a solution which allows the reciprocal rigid connection of the extrusion punch and the main cylinder crosspiece.

DESCRIPTION OF THE PRESENT INVENTION

According to the invention, the use of the side cylinders may be avoided by means of a solution which allows, when necessary and/or required, reciprocally rigidly restraining the movable punch holder crosspiece and the container so that when restrained to the movable punch holder crosspiece, the translations of the container result in corresponding translations of the movable punch holder crosspiece (and therefore, of the extrusion punch because it in turn is restrained to the movable punch holder crosspiece).

Therefore, based on both the previously summarized preset objects and the above considerations, the present invention relates to an extrusion press according to main claim 1, embodiments of the present invention being defined by the dependent claims.

According to a described embodiment, the extrusion press for producing metal items by extruding a metal billet comprises a crosspiece+extrusion die and a main cylinder including an extrusion punch adapted to be translated in two opposite directions, wherein the translation of said main cylinder in a first extrusion direction results in a push against said billet and in the extrusion of said billet through said extrusion die, said press comprising a container and a movable punch holder crosspiece, both being translatable in two opposite directions parallel to the translation directions of said extrusion punch, wherein said container is adapted to be translated by means of at least a first dedicated cylinder including a first dedicated rod rigidly fastened to said container, and wherein said container is adapted to be moved close to said extrusion die by means of said dedicated first cylinder and rod so as to contain said billet; said press comprising a first dedicated rigid bar rigidly fastened to said movable punch holder crosspiece; wherein said press comprises first locking means adapted to alternately act as a whole on said first dedicated rigid bar and free said first dedicated rigid bar, and wherein the locking action of said first locking means on said first dedicated rigid bar results in the reciprocal rigid connection of said main cylinder crosspiece and movable punch holder crosspiece.

According to an embodiment, said press comprises second locking means adapted to alternately act as a whole on said first dedicated rod and free said first dedicated rod, wherein the locking action of second first locking means on said first dedicated rod results in the reciprocal rigid connection of said container and movable punch holder crosspiece, and therefore wherein with said first dedicated rod blocked by said second locking means, the translation of said container results in the simultaneous translation of said movable punch holder crosspiece.

According to an embodiment, said at least a first dedicated rod extends through said movable punch holder crosspiece, wherein said second locking means are accommodated in said transverse head.

According to an embodiment, said at least a first dedicated rod extends through said second locking means.

According to an embodiment, said second locking means comprise a deformable sleeve through which said first dedicated rod extends, wherein said deformable sleeve is accommodated in a chamber in communication with a circuit of a pressurized fluid, and wherein the introduction of said pressurized fluid into said chamber results in the deformation of said deformable sleeve and in a transverse pressure applied by said sleeve to said first dedicated rod, and therefore in the blocking of said dedicated rod.

According to an embodiment, said container is adapted to be translated by means of at least a second dedicated cylinder including a second dedicated rod rigidly fastened to said container, wherein said container is adapted to be moved close to said extrusion die by means of said dedicated first cylinder and rod and dedicated second cylinder and rod so as to contain said billet at least partially; wherein said press comprises third locking means adapted to alternately act as a whole on said second dedicated rod and free said second dedicated rod, wherein the locking action of said third locking means on said second dedicated rod results in the reciprocal rigid connection of said container and movable punch holder crosspiece, and therefore wherein with said second dedicated rod blocked by said third locking means, the translation of said container results in the simultaneous translation of said movable punch holder crosspiece.

According to an embodiment, said at least a second dedicated rod extends through said movable punch holder crosspiece, wherein said third locking means are accommodated in said movable punch holder crosspiece.

According to an embodiment, said second dedicated rod extends through said third locking means.

According to an embodiment, said third locking means comprise a deformable sleeve through which said second dedicated rod extends, wherein said deformable sleeve is accommodated in a chamber in communication with a circuit of a pressurized fluid, and wherein the introduction of said pressurized fluid into said chamber results in the deformation of said deformable sleeve and in a transverse pressure applied by said sleeve to said second dedicated rod, and therefore in the blocking of said dedicated rod.

According to an embodiment, said first dedicated rigid bar extends through the main cylinder crosspiece, wherein said first locking means are accommodated in said main cylinder crosspiece.

According to an embodiment, said first dedicated rigid bar extends through said first locking means.

According to an embodiment, said first locking means comprise a deformable sleeve through which said first dedicated rigid bar extends, wherein said deformable sleeve is accommodated in a chamber in communication with a circuit of a pressurized fluid, and wherein the introduction of said pressurized fluid into said chamber results in the deformation of said deformable sleeve and in a transverse pressure applied by said sleeve to said first dedicated rigid bar, and therefore in the blocking of said first dedicated rigid bar.

According to an embodiment, said press comprises a second dedicated rigid bar rigidly fastened to said movable punch holder crosspiece; wherein said press comprises fourth locking means adapted to alternately act as a whole on said second dedicated rigid bar and free said second dedicated rigid bar, and wherein the locking action of said fourth locking means on said second dedicated rigid bar results in the reciprocal rigid connection of said main cylinder crosspiece and movable punch holder crosspiece.

According to an embodiment, said second dedicated rigid bar extends through the main cylinder crosspiece, wherein said fourth locking means are accommodated in said main cylinder crosspiece.

According to an embodiment, said second dedicated rigid bar extends through said fourth locking means.

According to an embodiment, said fourth locking means comprise a deformable sleeve through which said second dedicated rigid bar extends, wherein said deformable sleeve is accommodated in a chamber in communication with a circuit of a pressurized fluid, and wherein the introduction of said pressurized fluid into said chamber results in the deformation of said deformable sleeve and in a transverse pressure applied by said sleeve to said second dedicated rigid bar, and therefore in the blocking of said second dedicated rigid bar.

DETAILED DESCRIPTION OF THE DRAWINGS

A description is provided below of the embodiments of the present invention depicted in the drawings, in which.

Figure 1:
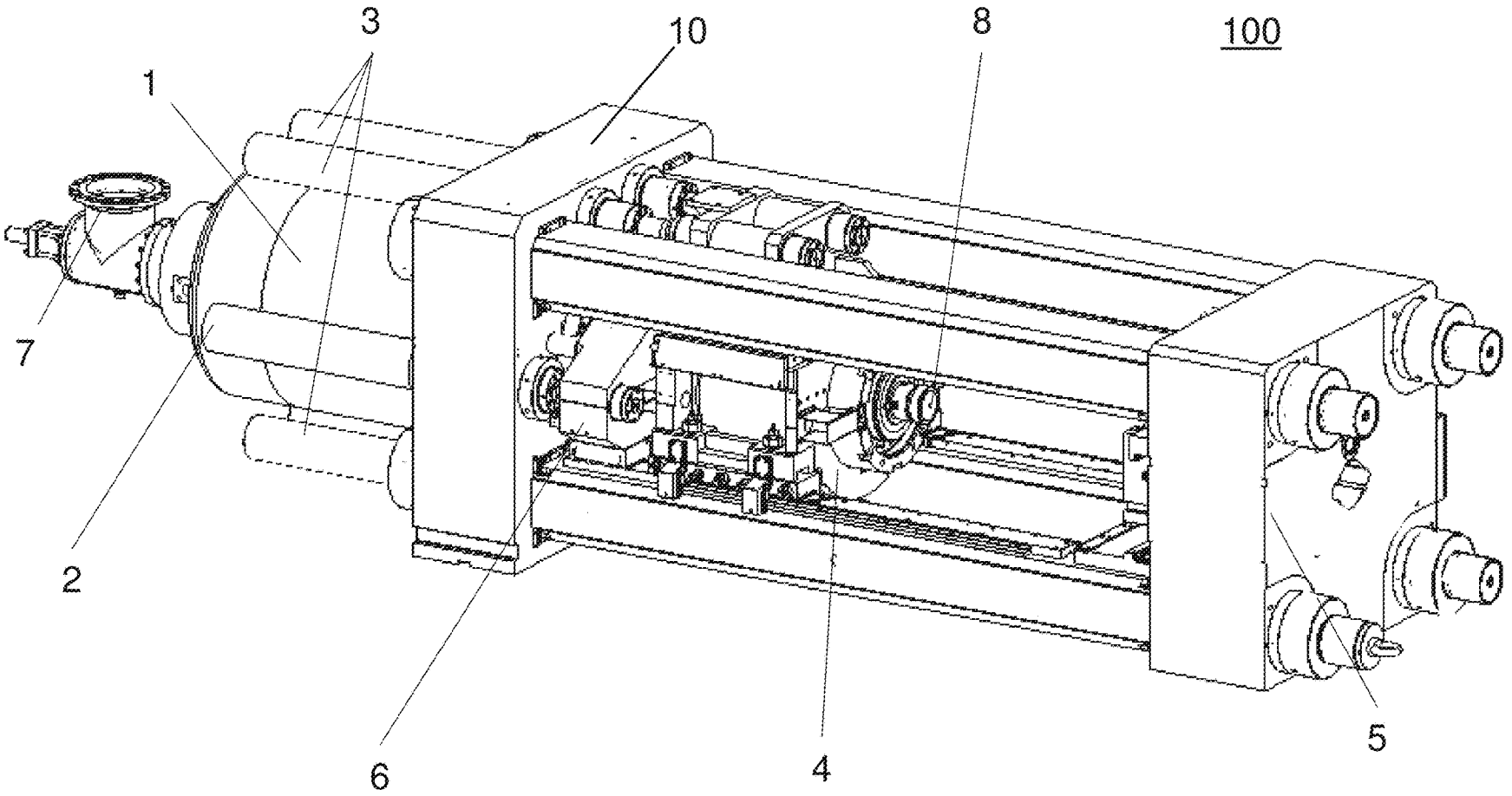
FIG.1 PRIOR ART
FIG. 1 shows a perspective view of an extrusion press according to the prior art.

In any case, it should be noted that the present invention is not limited to the embodiments described later and depicted in the drawings; contrarily, all those variants and/or modifications of the embodiments described below and depicted in the accompanying drawings which will be apparent and obvious to those skilled in the art fall within the scope of the present invention.

DETAILED DESCRIPTION OF THE PRESENT INVENTION

The application of the present invention is particularly advantageous in the case of front loading extrusion presses, this thus being the reason why the present invention is described below with particular reference to the applications thereof to a front loading press.

Nonetheless, it must be highlighted that the possible applications of the present invention are not limited to those described below. Contrarily, the present invention is adapted to be conveniently applied in all the cases in which independently reciprocally restraining two translatable parts or components is required, so that the translation of one results in the simultaneous translation of the other and vice versa.

Figure 10:
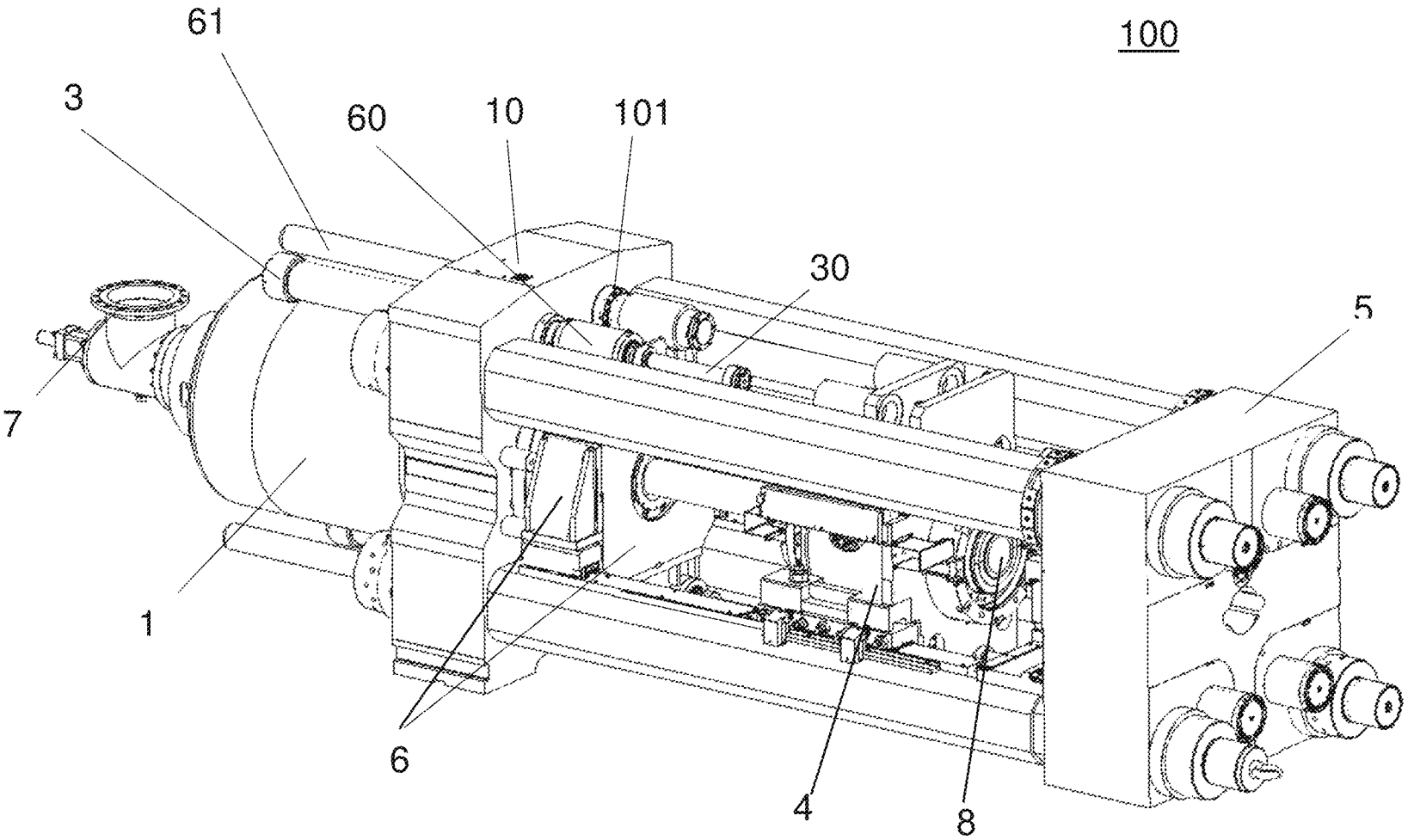

The extrusion press depicted in FIG. 10 is identified by reference numeral 100 and comprises a main cylinder 1, two or more cylinders 3 for translating (in two opposite translation directions) a container (not depicted), an extrusion die 5 and a movable punch holder crosspiece 6.

The main cylinder 1 is of the single-action type, wherein the chamber of cylinder 1 is placed in communication with a pre-filling valve 7 which in turn is in communication with a tank (not shown) of a hydraulic fluid, conventionally hydraulic oil. The closing of valve 7 following the increase of the pressure of the fluid (oil) in the chamber of cylinder 1 generates the forward translation of the extrusion punch 8 towards die 5. Contrarily, quick movements of the extrusion punch 8, both forwards towards die 5 and backwards (in jargon, for the "return" of rod 8), are obtained by means of the two dedicated cylinders 3, wherein at the end of the actual extrusion step, the extrusion punch 8 is "returned" (moved away from die 5), again by means of the dedicated cylinders 3. Indeed, as mentioned, press 100 according to the present invention is characterized by an innovative solution which allows container 4 and the movable punch holder crosspiece 6 and/or the movable punch holder crosspiece 6 and the main cylinder 1 to be reciprocally restrained when required and/or necessary, said innovative solution being described below with reference to FIGS. 2 to 6.

Figure 4:
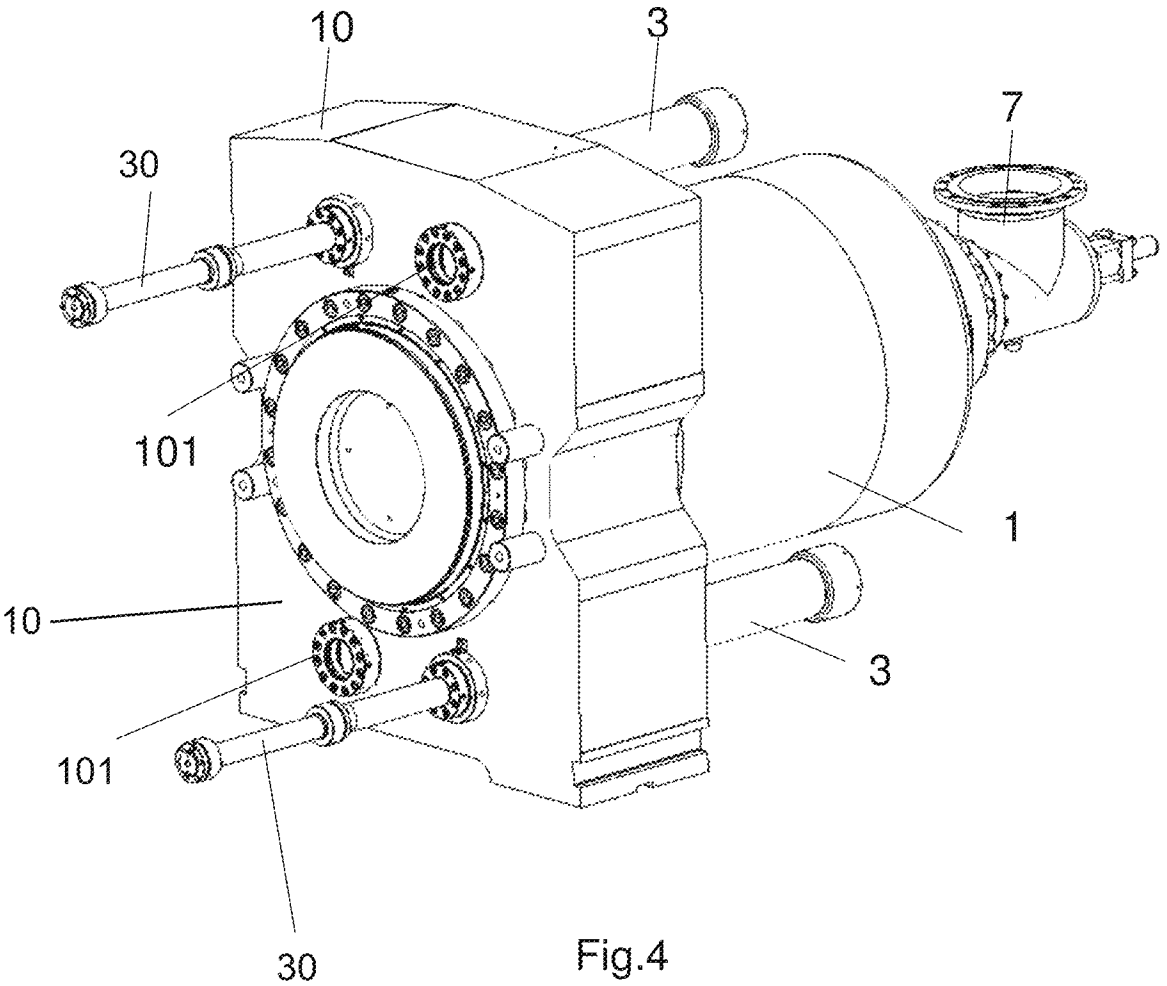
Figure 5:
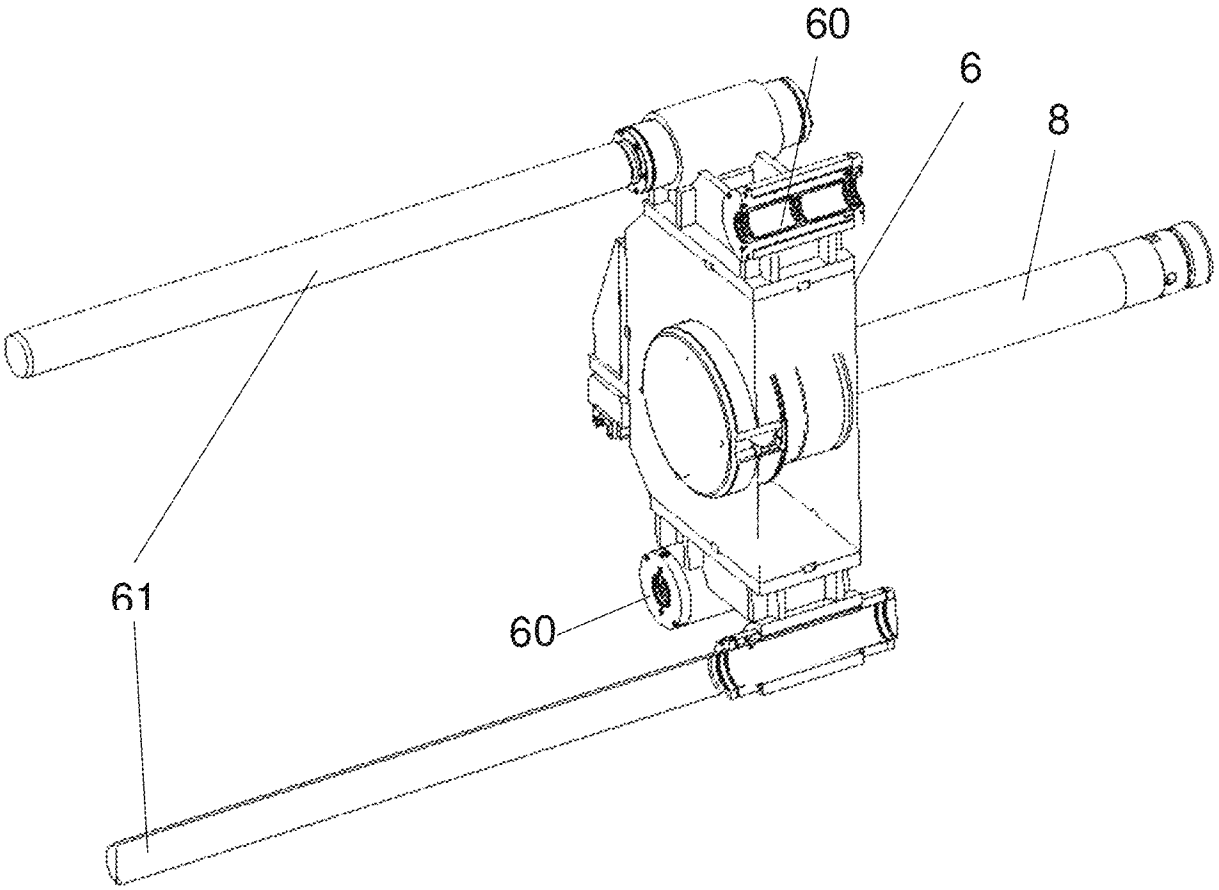
Figure 6:
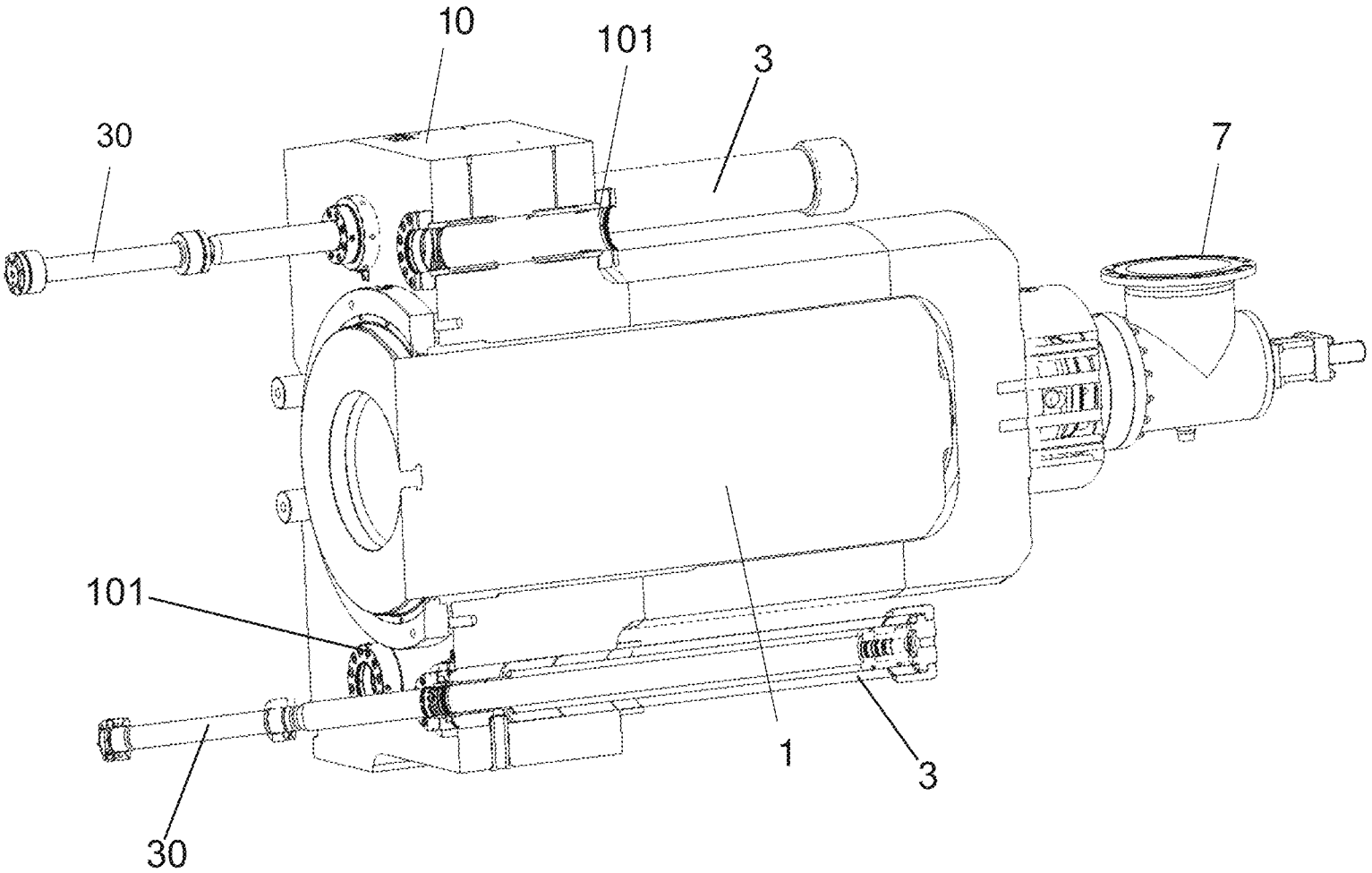
Figure 7:
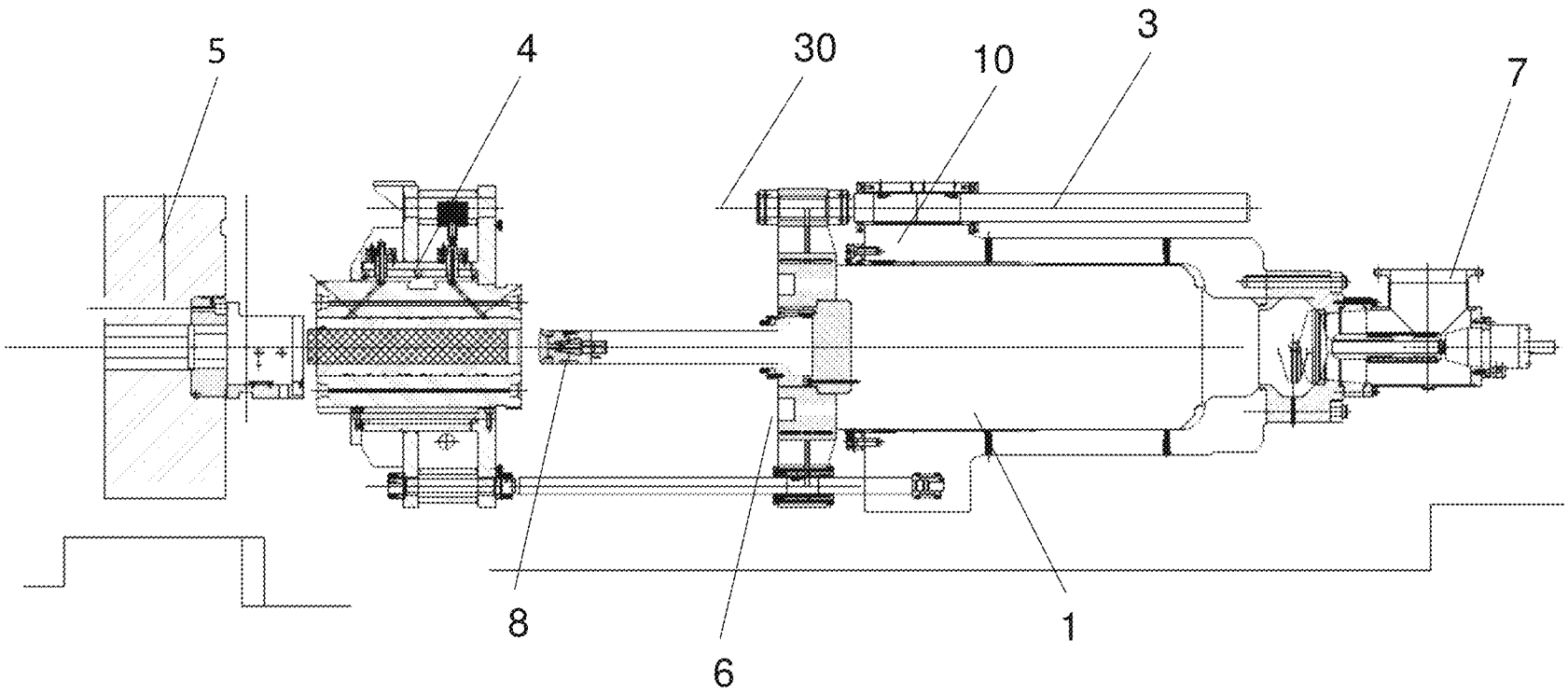
FIG. 7 shows a longitudinal sectional view of a press according to an embodiment.
Figure 8:
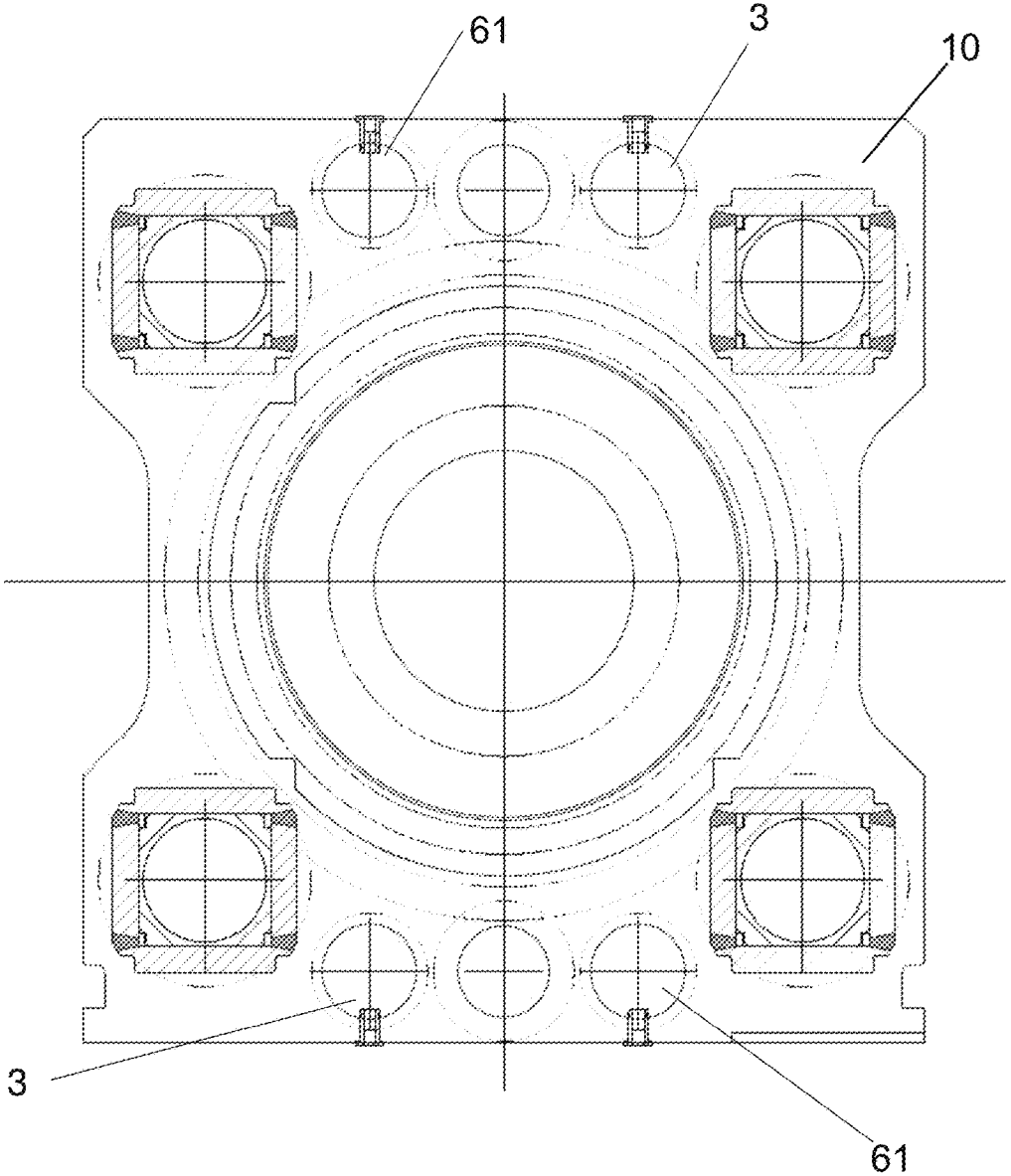
FIG. 8 shows a cross-section view of a press according to an embodiment.
Figure 9:
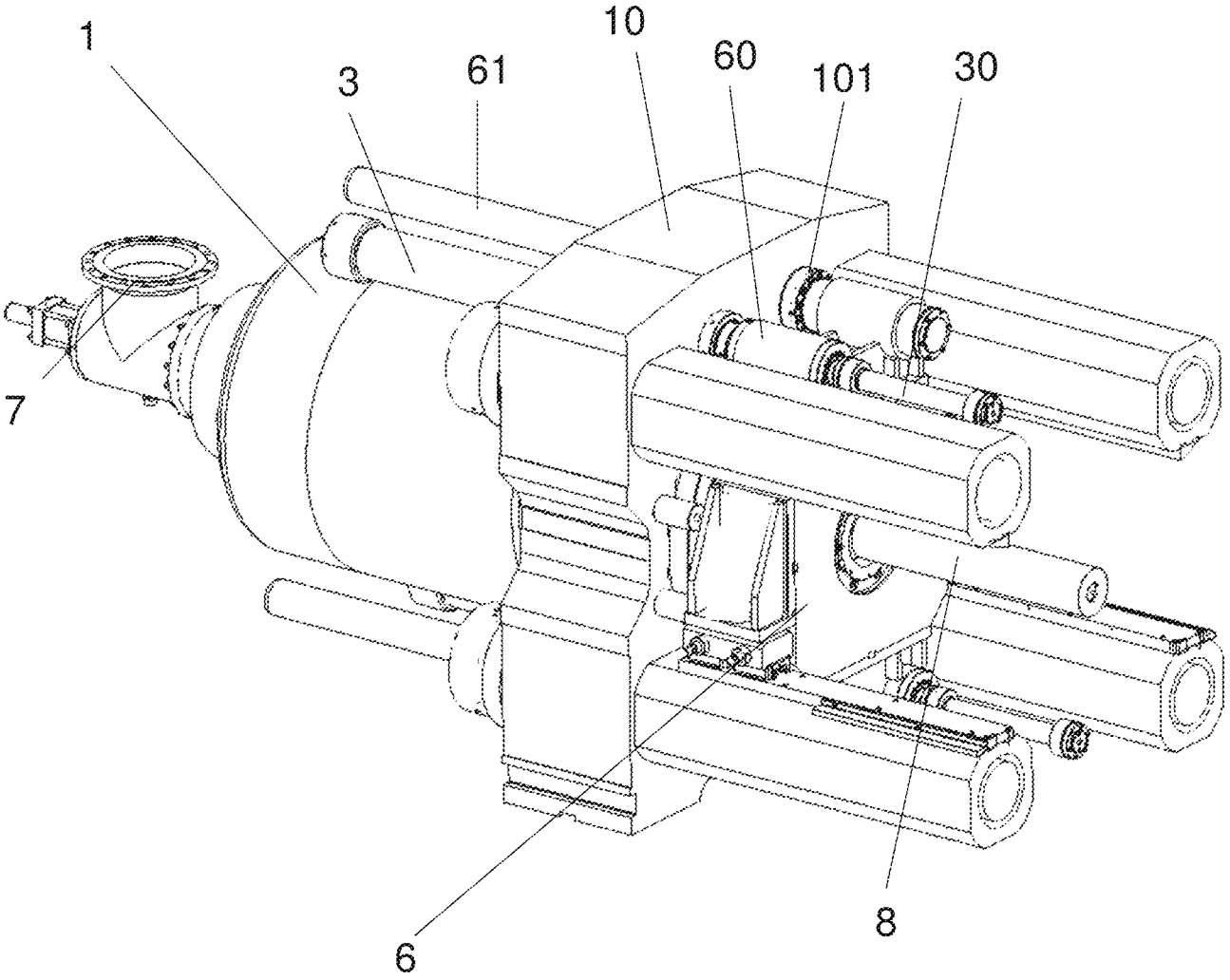
FIGS. 9 and 10 show perspective views of part of an extrusion press and an extrusion press according to an embodiment, respectively.

Reference numerals 30 in FIG. 4 identify the rods of the respective cylinders 3 (dedicated to the movement by translation of the container 4 and the movable punch holder crosspiece 6); the ends of the rods 30 are restrained to container 4 (FIG. 7), wherein the rods 30 extend through the movable transverse head 6. In particular, each rod 30 extends through respective locking or clamping means 60 accommodated in the movable punch holder crosspiece 6.

Figure 2:
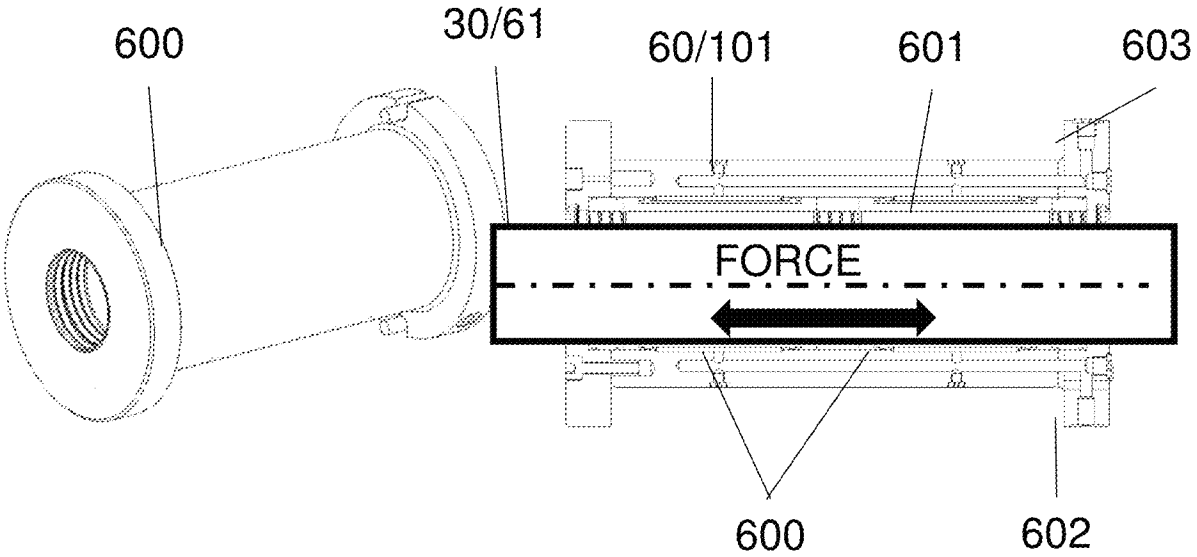
FIG. 2 shows a sectional view of locking means according to an embodiment.
Figure 3:
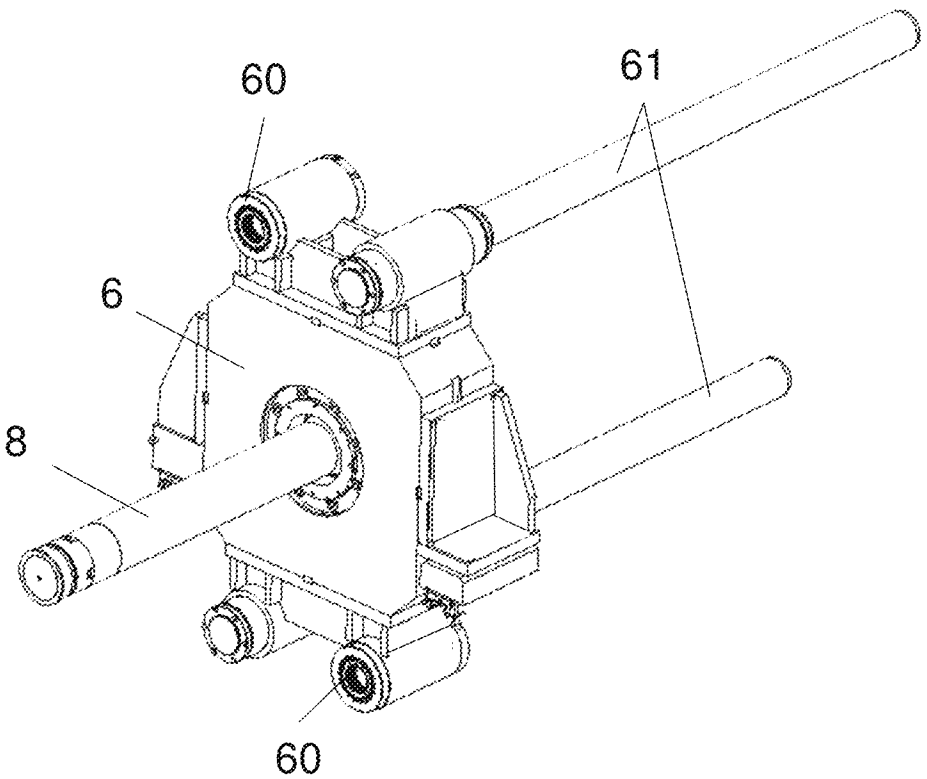
FIGS. 3, 4, 5 and 6 show perspective and partial sectional views of components of the press according to an embodiment.

The construction details of said clamping means 60 (as the other clamping means 101 described below) are depicted in FIG. 2, in which reference numeral 30 identifies said rod. As depicted, the locking means 60 comprise a hose or deformable sleeve 600 (made of special bronze) shaped like a hollow cylinder, wherein said hose 600 is accommodated is a chamber 601 in communication with a circuit of pressurized fluid (for example, oil) by means of a delivery 602 (reference numeral 603 indicating an air vent), wherein the introduction of oil into chamber 601 results in a pressure on hose 600, and therefore in a transverse force applied by hose 600 to rod 30, and therefore ultimately in a blocking or clamping of rod 30 such as to avoid longitudinal movements of rod 30 (with respect to the movable punch holder crosspiece 6). It indeed is shown that given that the locking or clamping means 60 are accommodated in the movable punch holder crosspiece 6, the blocking or clamping of the rods (of at least one rod 30) results in the reciprocal restraint between the rods 30 and the movable punch holder crosspiece 6, and therefore between the movable punch holder crosspiece 6 and container 4, and each translation of container 4 in a corresponding translation of the movable punch holder crosspiece 6.

Again as depicted, the movable punch holder crosspiece 6 comprises a pair of rigid bars 61 which extend through respective locking means 101 accommodated in the main cylinder crosspiece 10 of the main cylinder 1; given that said locking means 101 are similar to the locking means 60 described above with reference to FIG. 2, a further description thereof is omitted for reasons of brevity. Moreover, it should be noted that said locking means 101 comprise a deformable hose 600 (similar to hose 600 of the locking means 60) which is shaped like a hollow cylinder, wherein said hose 600 is accommodated is a chamber 601 in communication with a circuit of pressurized fluid (for example, oil) by means of a delivery 602 (reference numeral 603 indicating an air vent), wherein the introduction of oil into chamber 601 results in a pressure on hose 600, and therefore in a transverse force applied by hose 600 to bar 61, and therefore ultimately in a blocking or clamping of bar 61 such as to avoid longitudinal movements of bar 61 (with respect to the main cylinder crosspiece 10 which is rigidly connected to the fixed surface of the foundations). It indeed is shown that given that the locking or clamping means 101 are accommodated in the main cylinder crosspiece 10, the blocking or clamping of the bars 61 (of at least one bar 61) results in the reciprocal restraint between the movable punch holder crosspiece and the main cylinder crosspiece 10.

An extrusion cycle which may be carried out by means of a press according to one of the embodiments depicted in the drawings is described below by way of non-limiting example.

During a first step, a billet is loaded between the front face of the extrusion punch 8 and die 5;

during the next step, the extrusion punch 8 and container 4 are advanced, by means of the dedicated cylinders 3, towards die 5 in order to block the billet against the face of die 5 opposite to the extrusion punch 8 (during this step, container 4 and the transverse head 6 are reciprocally restrained by means of the locking means 60 which act on the rods 30);

during the next step, valve 7 is closed, container 4 is released from the movable punch holder crosspiece 6, while the movable punch holder crosspiece 6 is restrained to the main cylinder crosspiece 10;

container 5 is then advanced, by means of the dedicated cylinders 3, up to abutting against die 5 (and therefore so that the billet is contained in container 4), container 4 remaining released from the movable punch holder crosspiece 6 during this step;

after releasing the movable punch holder crosspiece from the main cylinder crosspiece 10, the billet is then upset by the push of the main cylinder 1, and therefore of the extrusion punch 8;

during the next step, container 4 is quickly opened and closed by means of the dedicated cylinders 3 (in order to allow the air possibly trapped in container 4 to escape); during this step, container 4 is released from the movable punch holder crosspiece 6 and the movable punch holder crosspiece 6 is restrained to the main cylinder crosspiece 10;

the next step is the actual extrusion step during which the extrusion punch 8 is pushed against the billet by means of increasing the pressure in the chamber of the main cylinder 1 (with the movable punch holder crosspiece 6 released from container 4);

during the next step, i.e., once the actual extrusion is complete, container 4 is opened (retracted) by means of the dedicated cylinders 3, while the movable punch holder crosspiece 6 is restrained to the main cylinder crosspiece by means of the rods 61 and the locks 101;

then, the extrusion punch 8 is also retracted together with container 4 by means of the dedicated cylinders 3 and with container 4 restrained to the movable punch holder crosspiece 6;

finally, any remains of the billet adhering to die 5 are removed.

The subsequent extrusion cycle thus starts with loading a new billet between the extrusion punch 8 and die 5 and continues according to the steps summarized above.

It has thus been demonstrated, by means of the above detailed description of the embodiments of the present invention depicted in the drawings, that the present invention allows achieving the desired results and overcoming or at least limiting the drawbacks found in the prior art.

In particular, the present invention provides an extrusion press, for example but not only a front loading extrusion press, which does not require the use of the side cylinders contrarily commonly used in the presses according to the prior art to quickly move the main rod, and which is thus characterized by low manufacturing dimensions and costs, requires less maintenance and is less subject to breakdowns and/or malfunctions and which moreover, avoids the risk of bending and/or distortions contrarily present in the presses according to the prior art because resulting from the use of the side cylinders during the actual extrusion step.

Although the present invention was clarified above by means of the detailed description of the embodiments depicted in the drawings, the present invention is not limited to the embodiments described and depicted in the drawings; contrarily, all those variants and/or modifications of the embodiments described and depicted in the accompanying drawings which will be apparent and obvious to those skilled in the art fall within the scope of the present invention.

For example, the locking means described with reference to the drawings may be replaced with "KOSTIRKA" type locking units or alternatively also with mechanical locking means such as ratchets or the like.

The scope of protection of the present invention is thus defined by the claims.

The invention claimed is:

1. An extrusion press for producing metal extrudates by extruding a billet, said press comprising:

an extrusion die crosspiece;

a main cylinder including an extrusion punch or pressing rod adapted to be translated in two opposite directions, wherein a translation of said extrusion punch or pressing rod in a first extrusion direction results in a push against said billet and in an extrusion of said billet through an extrusion die of said extrusion die crosspiece, a container and a movable punch holder crosspiece, both being translatable in two opposite directions parallel to the translation directions of said extrusion punch or pressing rod, wherein said container is adapted to be translated by means of at least a first dedicated cylinder including a first dedicated rod rigidly fastened to said container, and wherein said container is adapted to be moved close to said extrusion die by means of said at least a first dedicated cylinder and first dedicated rod so as to contain said billet;

a first dedicated rigid bar rigidly fastened to said movable punch holder crosspiece;

first locking means adapted to alternately lock and free said first dedicated rigid bar, wherein a locking action of said first locking means on said first dedicated rigid bar results in a reciprocal rigid connection of said extrusion punch, or pressing rod, and a main cylinder crosspiece.

2. The extrusion press according to claim 1, wherein said press further comprises second locking means alternately adapted to lock and free said first dedicated rod, wherein a locking action of said second locking means on said first dedicated rod results in a reciprocal rigid connection of said container and movable punch holder crosspiece, and thus wherein, with said first dedicated rod locked by said second locking means, the translation of said container results in a simultaneous translation of said movable punch holder crosspiece.

3. The press according to claim 2, wherein said first dedicated rod extends through said movable punch holder crosspiece, and wherein said second locking means are accommodated in said movable punch holder crosspiece.

4. The press according to claim 3, wherein said first dedicated rod extends through said second locking means.

5. The press according to claim 4, wherein said second locking means comprise a deformable sleeve through which said first dedicated rod extends, wherein said deformable sleeve is accommodated in a chamber in communication with a circuit of a pressurized fluid, and wherein an introduction of said pressurized fluid into said chamber results in a deformation of said deformable sleeve and in a transverse pressure applied by said deformable sleeve to said first dedicated rod, and therefore in a locking of said first dedicated rod.

6. The press according to claim 2, wherein said container is adapted to be translated by means of at least a second dedicated cylinder including a second dedicated rod rigidly fastened to said container, and wherein said container is adapted to be moved close to said extrusion die by means of said at least a first dedicated first cylinder and first dedicated rod and said at least a second dedicated cylinder and second dedicated rod so as to contain said billet at least partially; wherein said press further comprises third locking means adapted to alternately lock and free said second dedicated rod, wherein a locking action of said third locking means on said second dedicated rod results in a reciprocal rigid connection of said container and movable punch holder crosspiece, and thus wherein, with said second dedicated rod locked by said third locking means, the translation of said container results in a simultaneous translation of said movable punch holder crosspiece.

7. The press according to claim 6, wherein said second dedicated rod extends through said movable punch holder crosspiece, and wherein said third locking means are accommodated in said movable punch holder crosspiece.

8. The press according to claim 7, wherein said second dedicated rod extends through said third locking means.

9. The press according to claim 8, wherein said third locking means comprise a deformable sleeve through which said second dedicated rod extends, wherein said deformable sleeve is accommodated in a chamber in communication with a circuit of a pressurized fluid, and wherein an introduction of said pressurized fluid into said chamber results in a deformation of said deformable sleeve and in a transverse pressure applied by said deformable sleeve to said second dedicated rod, and therefore in a locking of said second dedicated rod.

10. The press according to claim 6, wherein said press further comprises a second dedicated rigid bar rigidly fastened to said movable punch holder crosspiece; wherein said press further comprises fourth locking means adapted to alternately lock and free said second dedicated rigid bar, and wherein a locking action of said fourth locking means on said second dedicated rigid bar results in a reciprocal rigid connection of said extrusion punch, or pressing rod, and movable punch holder crosspiece and said main cylinder crosspiece.

11. The press according to claim 10, wherein said second dedicated rigid bar extends through the main cylinder crosspiece of said main cylinder, and wherein said fourth locking means are accommodated in said main cylinder crosspiece of said main cylinder.

12. The press according to claim 11, wherein said second dedicated rigid bar extends through said fourth locking means.

13. The press according to claim 12, wherein said fourth locking means comprise a deformable sleeve through which said second dedicated rigid bar extends, wherein said deformable sleeve is accommodated in a chamber in communication with a circuit of a pressurized fluid, and wherein an introduction of said pressurized fluid into said chamber results in a deformation of said deformable sleeve and in a transverse pressure applied by said deformable sleeve to said second dedicated rigid bar, and therefore in a locking of said second dedicated rigid bar.

14. The press according to claim 1, wherein said first dedicated rigid bar extends through the main cylinder crosspiece of said main cylinder, and wherein said first locking means are accommodated in said main cylinder crosspiece of said main cylinder.

15. The press according to claim 14, wherein said first dedicated rigid bar extends through said first locking means.

16. The press according to claim 15, wherein said first locking means comprise a deformable sleeve through which said first dedicated rigid bar extends, wherein said deformable sleeve is accommodated in a chamber in communication with a circuit of a pressurized fluid, and wherein an introduction of said pressurized fluid into said chamber results in a deformation of said deformable sleeve and in a transverse pressure applied by said deformable sleeve to said first dedicated rigid bar, and therefore in a locking of said first dedicated rigid bar.

* * * * *